US010934893B2

(12) United States Patent
Kolvick et al.

(10) Patent No.: US 10,934,893 B2
(45) Date of Patent: Mar. 2, 2021

(54) COMBUSTOR ASSEMBLY LIFT SYSTEMS AND METHODS FOR USING THE SAME TO INSTALL AND REMOVE COMBUSTOR ASSEMBLIES

(71) Applicant: GENERAL ELECTRIC COMPANY, Schenectady, NY (US)

(72) Inventors: Sandra Beverly Kolvick, Greenville, SC (US); Jeffrey Scott LeBegue, Greenville, SC (US); Ansley Michelle Heard, Greenville, SC (US); Jesse Ellis Barton, Greenville, SC (US); Paul Robert Fernandez, Woodstock, GA (US); Adrian Adam Klejc, Mazowieckie (PL)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 15/779,317

(22) PCT Filed: Dec. 31, 2015

(86) PCT No.: PCT/PL2015/000222
§ 371 (c)(1),
(2) Date: May 25, 2018

(87) PCT Pub. No.: WO2017/116244
PCT Pub. Date: Jul. 6, 2017

(65) Prior Publication Data

US 2018/0306064 A1 Oct. 25, 2018

(51) Int. Cl.
*F01D 25/28* (2006.01)
*B66C 1/62* (2006.01)
(Continued)

(52) U.S. Cl.
CPC ..... *F01D 25/285* (2013.01); *B66C 1/62* (2013.01); *B66C 13/08* (2013.01); *F23R 3/002* (2013.01);
(Continued)

(58) Field of Classification Search
CPC . B66C 13/08; F05D 2230/68; F05D 2230/70; F01D 25/285
See application file for complete search history.

(56) References Cited

U.S. PATENT DOCUMENTS 1,858,183 A * 5/1932 Bridges ..... B66C 1/24 294/63.1
2,076,758 A * 4/1937 Whiting ..... B66C 1/12 294/74
(Continued)

FOREIGN PATENT DOCUMENTS

EP 2 236 939 A1 10/2010
EP 2236939 A1 * 10/2010 ..... F01D 25/285
(Continued)

OTHER PUBLICATIONS

Machine Translation of EP-2236939-A1 (Year: 2010).*
(Continued)

*Primary Examiner* — Jacob J Cigna
*Assistant Examiner* — Michael W Hotchkiss
(74) *Attorney, Agent, or Firm* — Armstrong Teasdale LLP

(57) ABSTRACT

A combustor assembly lift system (200) comprises an exterior lift frame (220) comprising a base portion (222) and an arm portion (224), wherein the arm portion extends away from a base portion to form an interior, and, an interior combustor assembly engagement frame (240) at least partially disposed in the interior of the exterior lift frame and configured to temporarily secure to at least a portion of a combustor assembly. The interior combustor assembly
(Continued)

engagement frame is connected to the base portion of the exterior lift frame.

17 Claims, 5 Drawing Sheets

(51) Int. Cl.
*B66C 13/08* (2006.01)
*F23R 3/00* (2006.01)
*F23R 3/46* (2006.01)

(52) U.S. Cl.
CPC ..... *F23R 3/46* (2013.01); *F05D 2230/68* (2013.01); *F05D 2230/70* (2013.01); *F05D 2240/35* (2013.01); *F23R 2900/00017* (2013.01)

(56) References Cited

U.S. PATENT DOCUMENTS 2,966,380 A * 12/1960 Swenson ..... B66C 1/125 294/119.2
3,253,851 A * 5/1966 Gilbert ..... B66C 1/12 294/119.2
3,915,311 A * 10/1975 Ball ..... B66C 1/46 414/766
4,088,361 A * 5/1978 Ditcher ..... B66C 1/666 294/82.1
4,433,830 A * 2/1984 Campbell ..... F01D 25/285 254/264
5,043,132 A * 8/1991 Schramm ..... B66C 1/12 376/260
5,255,950 A * 10/1993 Davies ..... B66C 1/64 294/101
5,653,351 A * 8/1997 Grout ..... B66C 19/005 212/315
6,141,862 A * 11/2000 Matsui ..... F01D 25/285 29/714
7,770,292 B2 * 8/2010 Stretton ..... B66C 1/10 269/17
7,779,540 B2 * 8/2010 McCaffrey ..... B66C 11/04 29/889.2
8,402,625 B2 * 3/2013 Holmes ..... B23B 41/00 29/281.4
8,713,776 B2 * 5/2014 Herbold ..... F23R 3/002 29/256
8,720,059 B2 * 5/2014 West ..... F01D 25/285 248/544
9,144,866 B2 * 9/2015 Holmes ..... F01D 9/023
9,512,723 B2 * 12/2016 Muller ..... B25B 27/06
9,714,585 B2 * 7/2017 Morey ..... B62B 3/02
9,938,860 B2 * 4/2018 Alvarez ..... F02C 7/264
9,957,138 B2 * 5/2018 Schorn ..... B66C 1/16
10,132,243 B2 * 11/2018 Jorgensen ..... F23R 3/60
10,174,637 B2 * 1/2019 Imfeld ..... F01D 25/285
10,253,650 B2 * 4/2019 Muller ..... F23R 3/60
2003/0014854 A1 * 1/2003 Brown ..... B25B 27/023 29/426.5
2011/0000080 A1 * 1/2011 Arase ..... F01D 9/023 29/700
2014/0215800 A1 * 8/2014 Griese ..... F23R 3/60 29/464
2015/0337685 A1 11/2015 Golubic et al.
2017/0138218 A1 * 5/2017 Waki ..... F01D 25/285

FOREIGN PATENT DOCUMENTS

EP 2 905 430 A1 8/2015
JP S541701 A 1/1979
JP H08210642 A 8/1996
JP H10194665 A 7/1998
JP 2000107949 A 4/2000
JP 3382746 B2 3/2003
JP 2016008595 A 1/2016
WO 2015/198858 A1 12/2015

OTHER PUBLICATIONS

International Search Report and Written Opinion issued in connection with corresponding PCT Application No. PCT/PL2015/000222 dated Sep. 20, 2016.
International Preliminary Report on Patentability issued in connection with corresponding PCT Application No. PCT/PL2015/000222 dated Jul. 3, 2018.
JP Notice of Reasons for Refusal for JP Patent Application 2018-533672 dated Jul. 3, 2020; 27 pp.

* cited by examiner

COMBUSTOR ASSEMBLY LIFT SYSTEMS AND METHODS FOR USING THE SAME TO INSTALL AND REMOVE COMBUSTOR ASSEMBLIES

BACKGROUND OF THE INVENTION

The subject matter disclosed herein relates to combustor assemblies and, more specifically, to apparatuses and methods for installing and removing combustor assemblies with respect to a gas turbine.

Gas turbines can include a compressor section, a combustion section, and a turbine section. The compressor section pressurizes air flowing into the turbine. The pressurized air discharged from the compressor section flows into the combustion section, which is generally characterized by a plurality of combustors. Each of the plurality of combustors includes a combustion liner, which defines the combustion chamber of the combustor. As such, air entering each combustor is mixed with fuel and combusted within the combustion liner. Hot gases of combustion flow from the combustion liner through a transition piece to the turbine section of the gas turbine to drive the turbine and generate power More specifically, a gas turbine combustor mixes large quantities of fuel and compressed air and burns the resulting mixture. Combustors for industrial gas turbines can include an annular array of cylindrical combustion "cans" in which air and fuel are mixed and combustion occurs. Compressed air from an axial compressor flows into the combustor. Fuel is injected through fuel nozzle assemblies that extend into each can. The mixture of fuel and air burns in a combustion chamber of each can. The combustion gases discharge from each can into a duct that leads to the turbine.

In some embodiments, combustor assemblies designed for low emissions, may include premix chambers and combustion chambers. Fuel nozzle assemblies in each combustor assembly inject fuel and air into the chambers of the can. A portion of the fuel from the nozzle assembly is discharged into the premix chamber of the can, where air is added to and premixed with the fuel. Premixing air and fuel in the premix chamber promotes rapid and efficient combustion in the combustion chamber of each can, and low emissions from the combustion. The mixture of air and fuel flows downstream from the premix chamber to the combustion chamber which supports combustion and under some conditions receives additional fuel discharged by the front of the fuel nozzle assembly. The additional fuel provides a means of stabilizing the flame for low power operation, and may be completely shut off at high power conditions.

Combustor assemblies need to be installed during the initial build of the gas turbine and may subsequently be removed during subsequent maintenance activities. However, to install, remove or re-install a combustor assembly, a significant amount of force may be required to properly lift, position and/or align the combustor assembly with respect to the combustor assembly. Accordingly, alternative apparatuses and methods for installing and removing combustor assemblies with respect to a gas turbine would be welcome in the art.

BRIEF DESCRIPTION OF THE INVENTION

In one embodiment, a combustor assembly lift system comprises an exterior lift frame comprising a base portion and an arm portion, wherein the arm portion extends away from a base portion to form an interior, and, an interior combustor assembly engagement frame at least partially disposed in the interior of the exterior lift frame and configured to temporarily secure to at least a portion of a combustor assembly. The interior combustor assembly engagement frame is connected to the base portion of the exterior lift frame.

In another embodiment, a method for installing a combustor assembly on a turbomachine is disclosed. The method comprises disposing a combustor assembly lift system proximate the combustor assembly. The combustor assembly lift system comprises an exterior lift frame comprising a base portion and an arm portion, wherein the arm portion extends away from a base portion to form an interior, and an interior combustor assembly engagement frame at least partially disposed in the interior of the exterior lift frame and configured to temporarily secure to at least a portion of a combustor assembly, wherein the interior combustor assembly engagement frame is connected to the base portion of the exterior lift frame. The method further comprises temporarily securing the interior combustor assembly engagement frame to the combustor assembly, aligning and securing the combustor assembly with the turbomachine, and releasing the combustor assembly from the interior combustor assembly engagement frame.

In yet another embodiment, a method for removing a combustor assembly from a turbomachine is disclosed. The method comprises disposing a combustor assembly lift system proximate the combustor assembly. The combustor assembly lift system comprises an exterior lift frame comprising a base portion and an arm portion, wherein the arm portion extends away from a base portion to form an interior, and an interior combustor assembly engagement frame at least partially disposed in the interior of the exterior lift frame and configured to temporarily secure to at least a portion of a combustor assembly, wherein the interior combustor assembly engagement frame is connected to the base portion of the exterior lift frame. The method further comprises temporarily securing the interior combustor assembly engagement frame to the combustor assembly and releasing the combustor assembly from the turbomachine and moving the combustor assembly lift system away from the turbomachine via one or more connections to the exterior lift frame.

These and additional features provided by the embodiments discussed herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the inventions defined by the claims. The following detailed description of the illustrative embodiments can be understood when read in conjunction with the following drawings, where like structure is indicated with like reference numerals and in which:

DETAILED DESCRIPTION OF THE INVENTION

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

Figure 1:
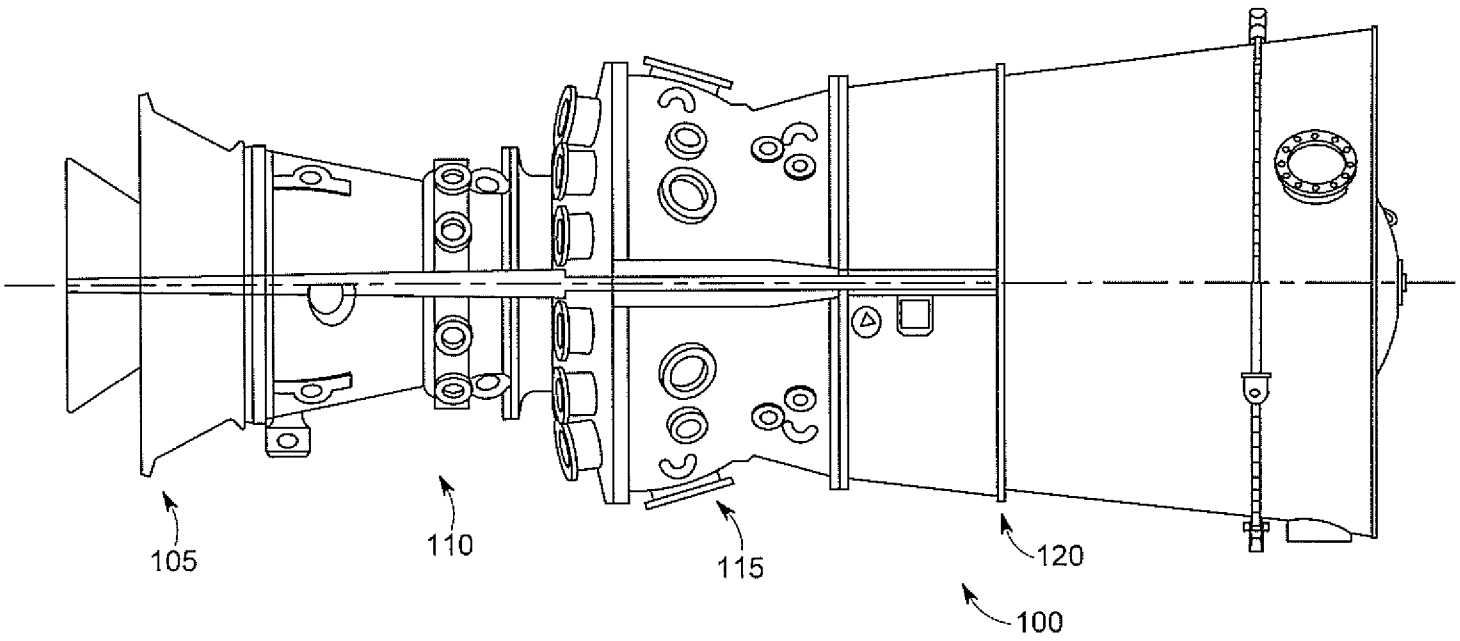
FIG. 1 is a side view of a turbomachine according to one or more embodiments shown or described herein.

Referring now to FIG. 1, some turbomachines, such as gas turbines, aero-derivatives, or the like, burn a fuel and an air mixture during a combustion process to generate energy. FIG. 1 illustrates an example of a turbomachine 100. Generally, the turbomachine 100 comprises an inlet plenum 105 that directs an airstream towards a compressor housed in a compressor casing 110. The airstream is compressed and then discharged to a combustion system 115, where a fuel, such as natural gas, is burned to provide high-energy combustion gases, which drives the turbine section 120. In the turbine section 120, the energy of the hot gases is converted into work, some of which is used to drive the compressor, with the remainder available for useful work to drive a load such as the generator, mechanical drive, or the like (none of which are illustrated).

Figure 2:
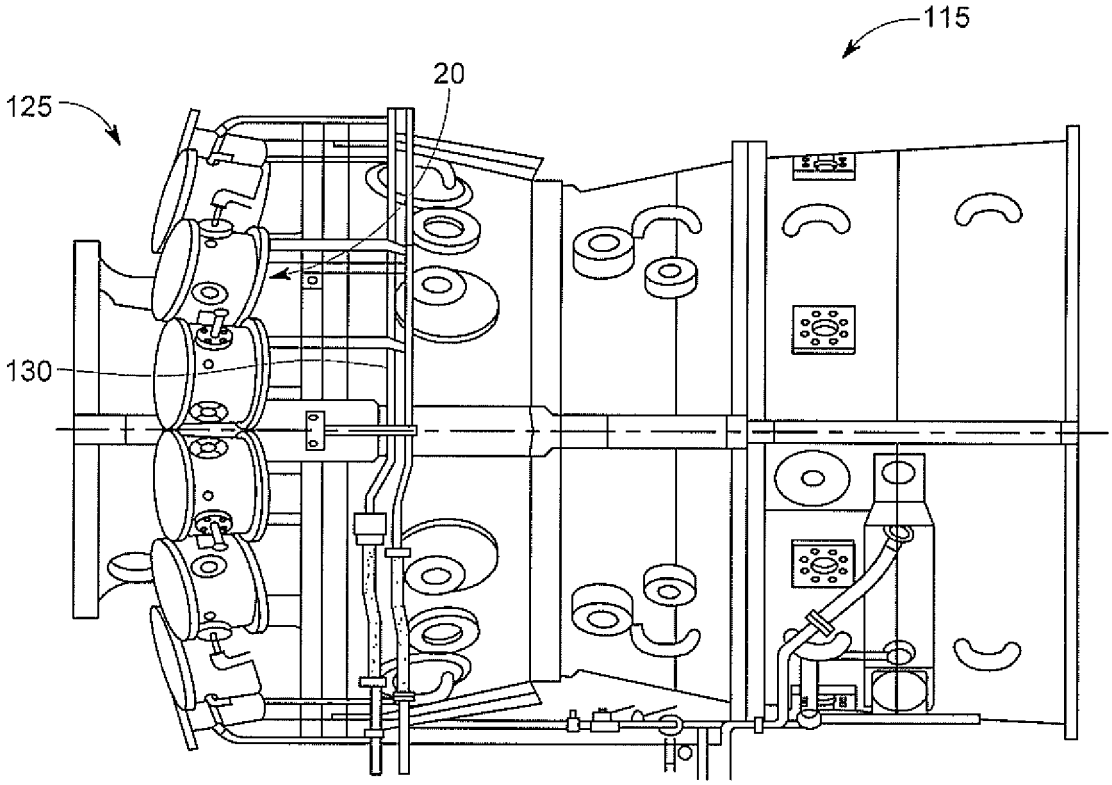
FIG. 2 is a side view of a combustion system according to one or more embodiments shown or described herein.

Referring now additionally to FIG. 2, an embodiment of the combustion system 115 may comprise at least one combustor assembly 20. Some turbomachines 100, such as that illustrated in FIG. 2, may comprise a plurality of combustor assemblies 20 disposed in an annular array around a central axis A. Generally, within each of combustor assembly 20 the aforementioned combustion process occurs. In some embodiments, combustor assemblies 20 can comprise one or more auxiliary systems 130 such as flame detection systems to monitor the flame burning in some of the combustor assemblies 20. Such flame detection systems may be in the form of a flame scanner, a portion of which may be inserted within the combustor assembly 20. Additional or alternative auxiliary systems 130 may similarly be incorporated into combustor assemblies 20 to monitor, control and/or impact one or more of the combustor assembly processes.

Figure 3:
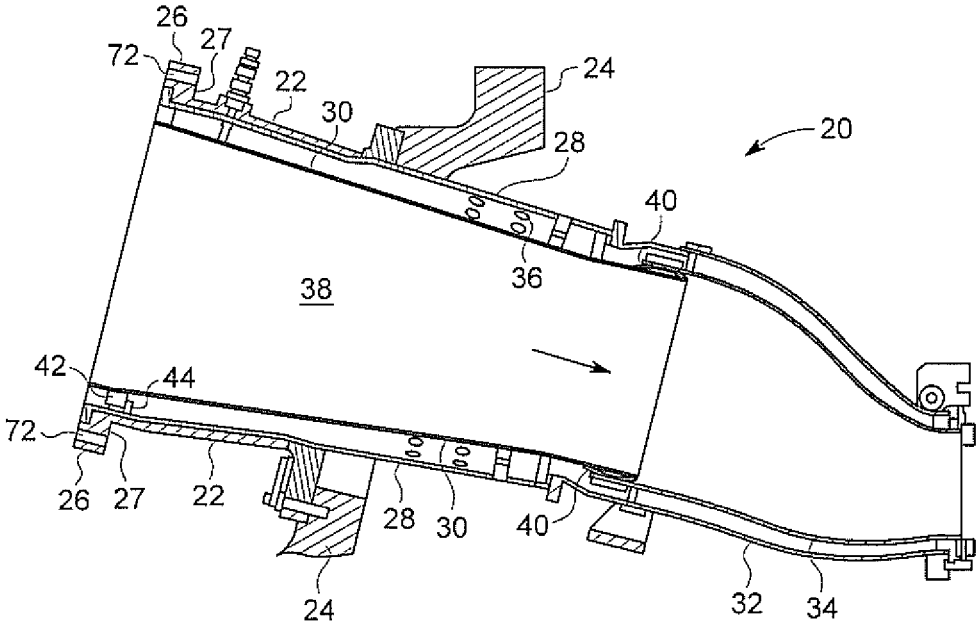
FIG. 3 is a cross-sectional side view of a combustor assembly according to one or more embodiments shown or described herein.

Referring additionally to FIG. 3, a cross-sectional side view of an embodiment of a combustor assembly 20 of a turbomachine 100 is illustrated. The combustor assembly 20 may generally include at least a combustion can 125 and potentially a substantially cylindrical combustion casing 22 secured to a portion of a gas turbine casing 24, such as a compressor discharge casing or a combustion wrapper casing. As shown, a flange 26 may extend outwardly from an upstream end of the combustion casing 22. The flange 26 may generally be configured such that an end cover assembly of a combustor assembly 20 may be secured to the combustion casing 22. For example, the flange 26 may define a plurality of flange holes 72 for attaching the end cover assembly to the combustion casing 22.

In some embodiments, the combustor assembly 20 may also include an internal flow sleeve 28 and a combustion liner 30 substantially concentrically arranged within the flow sleeve 28. The combustor assembly 20 may comprise a unibody combustor assembly 20 comprising the combustion can 125 and at least one of the flow sleeve 28 or combustion liner 30 connected to the combustion can 125 as a single pre-assembled structure, or the combustor assembly 20 may comprise an assembly where the combustion can 125, flow sleeve 28 and combustion liner 30 all connect directly to the turbomachine 100 such as to the turbine casing 24 (sometimes referred to as a combustion discharge casing or "CDC"). For example, the flow sleeve 28 and the combustion liner 30 may extend, at their downstream ends, to a double walled transition duct, including an impingement sleeve 32 and a transition piece 34 disposed within the impingement sleeve 32. It should be appreciated that in some embodiments the impingement sleeve 32 and the flow sleeve 28 may be provided with a plurality of air supply holes 36 over a portion of their surfaces, thereby permitting pressurized air from the compressor section 12 to enter the radial space between the combustion liner 30 and the flow sleeve 28.

The combustion liner 30 of the combustor assembly 20 may generally define a substantially cylindrical combustion chamber 38, wherein fuel and air are injected and combusted to produce hot gases of combustion. Additionally, the combustion liner 30 may be coupled at its downstream end to the transition piece 34 such that the combustion liner 30 and the transition piece 34 generally define a flow path for the hot gases of combustion flowing from each combustor assembly 20 to the turbine section 16 of the turbine assembly 10.

In some embodiments, such as that illustrated in FIG. 32, the transition piece 34 may be coupled to the downstream end of the combustion liner 30 with a seal 40 (e.g., a compression seal). For example, the seal 40 may be disposed at the overlapping ends of the transition piece 34 and combustion liner 30 to seal the interface between the two components. For example, a seal 40 may comprise a circumferential metal seal configured to be spring/compression loaded between inner and outer diameters of mating parts. It should be appreciated, however, that the interface between the combustion liner 30 and the transition piece 34 need not be sealed with a compression seal 40, but may generally be sealed by any suitable seal known in the art.

In some embodiments, the combustion liner 30 may also include one or more male liner stops 42 that engage one or more female liner stops 44 secured to the flow sleeve 28 or, in combustor assemblies 20 without a flow sleeve 28, the combustion casing 22. In particular, the male liner stops 42 may be adapted to slide into the female liner stops 44 as the combustion liner 30 is installed within the combustor assembly 20 to indicate the proper installation depth of the combustion liner 30 as well as to prevent rotation of the liner 30 during operation of the turbine assembly 10. Moreover, it should be appreciated that, in some embodiments, male liner stops 42 may be additionally or alternatively disposed on the flow sleeve 28 or combustion casing while the female liner stops 44 are disposed on the combustion liner 30.

In some embodiments, the combustion liner 30 may first be installed within a combustor assembly 20, by being pushed into the combustor assembly 20. For example, the combustion liner 30 can be pushed into the combustor assembly 20 until a force limits further installation depth into the transition piece 34. With continued reference to FIG. 2, a combustion can 125 can then be installed into each respective combustor assembly 20. Specifically, the combustion can 125 can be positioned, aligned and inserted such that its end cover assembly abuts against the flange 26 of the combustor assembly 20.

While specific embodiments have been presented herein, it should be appreciated that the combustor assembly 20 may comprise a variety of different components that are assembled in a variety of different orders with respect to the individual connections made with the turbomachine 100. For example, the combustor assembly 20 may be completely assembled prior to installation onto the turbomachine 100 (e.g., a unibody combustor assembly 20), may be partly assembled prior to installation on the turbomachine 100, may be completely assembled while connected to the turbomachine 100, or combinations thereof.

With additional reference to FIGS. 4-7, a combustor assembly lift system 200 can be provided to help install, remove, or re-install the combustor assembly 20 onto the turbomachine 100. Specifically, the combustor assembly lift system 200 can enable the installation and removal of one or more combustor assemblies 20 while providing proper alignment specific to each component. The combustor assembly lift system 200 can also enable a continuous installation and/or removal process by being able to grab the combustor assembly 20 while the combustor assembly 20 is in a shipping container, move the combustor assembly 20 into proper position and alignment within the turbomachine 100, and reverse the entire process without the need to exchange the combustor assembly 20 between multiple different lift systems.

The combustor assembly lift system 200 can generally comprise an exterior lift frame 220 and an interior combustor assembly engagement frame 240. The exterior lift frame 220 can comprise an exterior frame structure that helps facilitate the overall lifting and movement of the combustor assembly lift system 200. The interior combustor assembly engagement frame 240 can be disposed in the interior of the exterior lift frame 220 and be configured to temporarily secure to at least a portion of a combustor assembly 20. Moreover, the interior combustor assembly engagement frame 240 can be connected to a base portion 222 of the exterior lift frame 220 in a variety of configurations to help facilitate the overall lifting, transportation, rotation, alignment, installation and/or removal of one or more combustor assemblies 20 with respect to the individual slots of a turbomachine 100.

Figure 4:
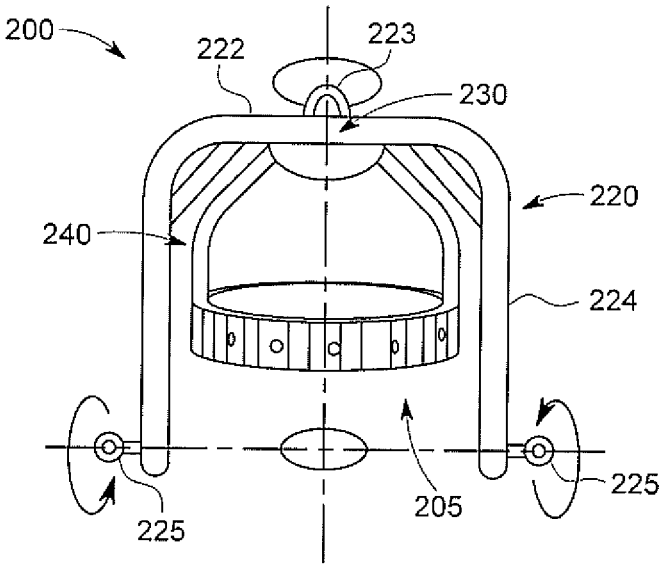
FIG. 4 is a perspective view of a combustor assembly lift system according to one or more embodiments shown or described herein.
Figure 5:
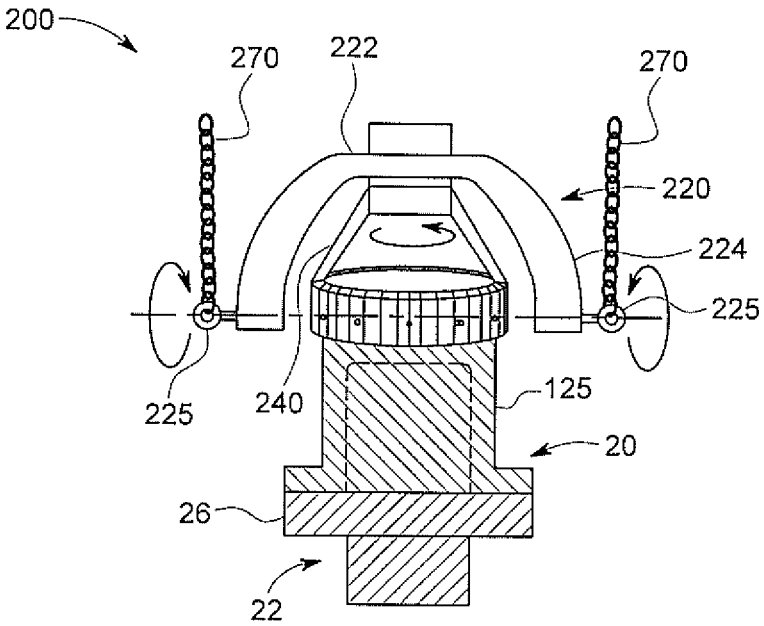
FIG. 5 is a perspective view of a combustor assembly lift system with a combustor assembly temporarily secured thereto according to one or more embodiments shown or described herein.
Figure 6:
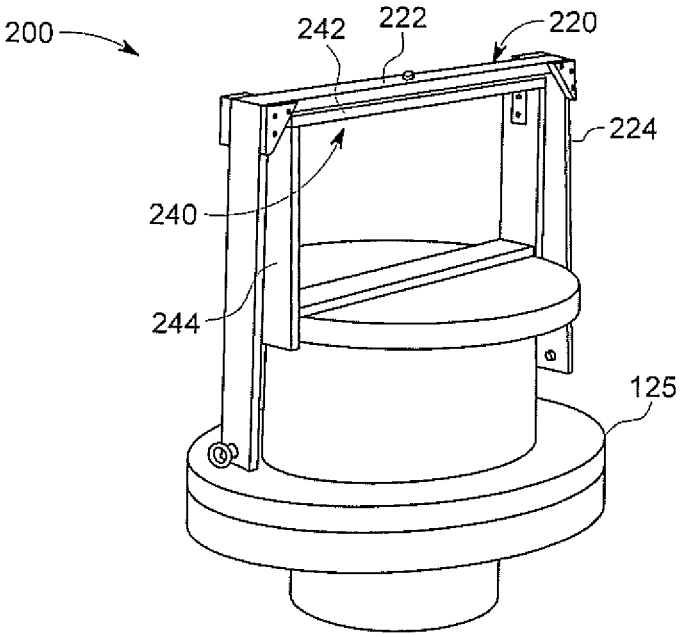
FIG. 6 is a perspective view of the combustor assembly lift system illustrated in FIG. 5 in a different configuration according to one or more embodiments shown or described herein.
Figure 7:
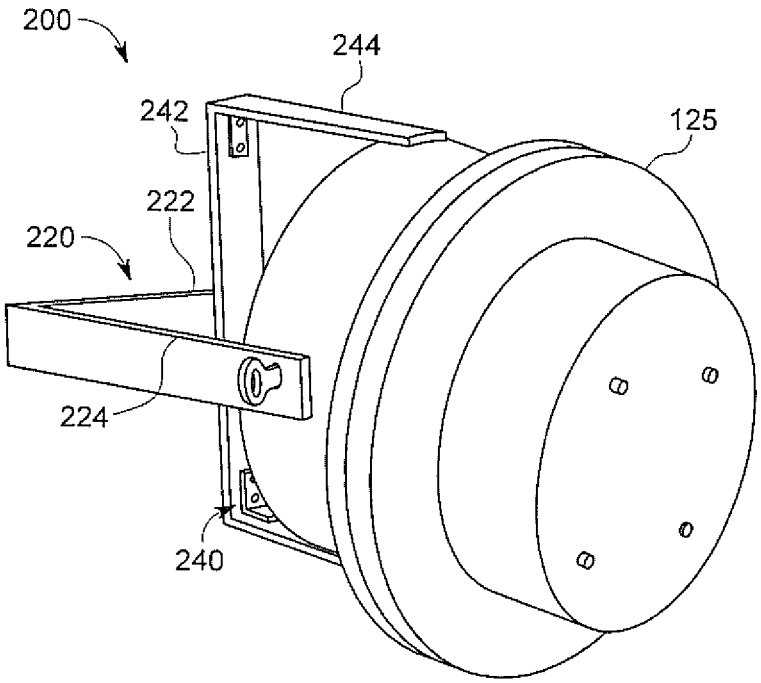
FIG. 7 is a perspective view of another combustor assembly lift system with a combustor assembly temporarily secured thereto according to one or more embodiments shown or described herein.

Still referring additionally to FIGS. 4-7, the exterior lift frame 220 can generally comprise a base portion 222 and an arm portion 224 wherein the arm portion 224 extends away from the base portion 222 to form an interior 205. The exterior lift frame 220 can thereby provide an exterior structure to facilitate the overall lifting and movement of the combustor assembly lift system 200, including when a combustor assembly 20 is temporarily secured to the interior combustor assembly engagement frame 240 as illustrated in FIGS. 5-7.

The exterior lift frame 220 may thereby comprise a variety of configurations and materials suitable for supporting a combustor assembly 20 during movement. In some embodiments, such as those illustrated in FIGS. 6 and 7, the exterior lift frame 220 can comprise a substantially straight base portion 222 with one or more substantially straight arm portions 224 extending from the base portion 222. In such embodiments, the substantially straight arm portions 224 may extend from the substantially straight base portion 222 at an angle of about 90 degrees or greater. Such embodiments may help ensure suitable space for the combustor assembly 20 to enter the interior 205 of the combustor assembly lift system 200. In some embodiments, the base portion 222 and/or the arm portion 224 may comprise more curved or tapered configurations such as illustrated in FIGS. 4 and 5. Such embodiments may assist in load transferring throughout the exterior lift frame 220 while also ensuring suitable space for the combustor assembly 20 to enter the interior of the combustor assembly lift system 200.

Moreover, the exterior lift frame 220 can contain any amount of elements combined together to form the overall base portion 222 and arm portion 224. For example, the exterior lift frame 220 may comprise one or more distinct arms extending from a distinct base as illustrated in FIGS. 6 and 7. In some embodiments, the exterior lift frame 220 may comprise a single curved structure (e.g., a bell shaped structure) that comprises both the base portion 222 and the arm portion 224. In even some embodiments, the exterior lift frame 220 may comprise a combination of these configurations to facilitate the overall lifting and movement of the combustor assembly lift system 200.

The exterior lift frame 220 may further comprise one or more pick points to assist in the lifting and movement of the overall combustor assembly lift system 200. As used herein, pick points may comprise any feature attached to or integral with one or more parts of the combustor assembly lift system 200 to provide a hook, ring, handle or other similar grabbing point. Pick points may thereby be used to attach chains 270 or other external lifting mechanisms to the combustor assembly lift system 200. For example, one or more pick points may comprise rings bolted, welded or staked to a portion of the exterior lift frame 220 such that hooks on the end of chains 270 can grab the one or more pick points when the chains are used to lift and move the combustor assembly lift system 200.

Pick points may be disposed at a variety of locations around the combustor assembly lift system 200. For example, in some embodiments, the arm portion 224 of the exterior lift frame 220 may comprise one or more side pick points 225. The side pick points 225 may help facilitate rotational movement of the combustor assembly lift system 200 such as for aligning combustor assemblies 20 with combustor assemblies 20. In some embodiments, at least one of the one or more side pick points 225 may be disposed about a center of gravity of the combustor assembly lift system 200 when it is secured to a combustor assembly 20.

Such embodiments may further assist in vertical rotational alignment by promoting more balanced loads.

In some embodiments, the base portion 222 of the exterior lift frame 220 may comprise one or more base pick points 223. The one or more base pick points 223 may help facilitate the vertical lifting of the combustor assembly lift system 200, such as when removing a combustor assembly 20 from a shipping container prior to installation or lowering a combustor assembly 20 into a shipping container after removal. As used herein, shipping container can refer to any box, crate or the like that houses the combustor assembly 20 during shipment to or from the location of a turbomachine 100. In some embodiments, the one or more base pick points 223 may be disposed about a center of gravity of the combustor assembly lift system 200 when it is secured to a combustor assembly 20. Such embodiments may assist in limiting tilted or unbalanced loads from being moved around during an installation or removal process.

Still referring to FIGS. 4-7, the exterior lift frame 220 may comprise one or more additional features to assist with one or more steps of combustor assembly removal and/or installation. For example, the arm portion 224 of the exterior lift frame 220 may comprise one or more features to assist with aligning a combustor assembly 20 with its respective slot of the turbomachine 100. Accordingly, in some embodiments, the arm portion 224 of the exterior lift frame 220 may comprise one or more alignment bolts configured to engage one or more holes on the turbomachine 100. The alignment bolts may thereby bring the overall combustor assembly lift system 200 into proper alignment with the turbomachine 100 to help remove or install the combustor assembly 20 at the proper angle. It should be appreciated that alignment bolts as used herein may refer to any bolt, rod, screw, or other instrument that can temporarily be inserted into one or more flange holes 72 of the combustion casing.

In some embodiments, the combustor assembly lift system 200 may comprise a protective barrier that extends at least partially around the arm portion 224 of the exterior lift frame 220. The protective barrier may comprise any sheet, cage, wall or other material that restricts or prevents external access into the interior 205 of the combustor assembly lift system 200. By restriction such access, the protective barrier may help protect a combustor assembly 20 and its corresponding elements (e.g., pipes, tubes, cords or the like) from unintended or unwanted contact. The protective barrier may extend around the entirety of the exterior lift frame 220 or for only one or more portions of the exterior lift frame 220.

Referring still to FIGS. 4-7, the combustor assembly lift system 200 further comprises an interior combustor assembly engagement frame 240 at least partially disposed in the interior 205 of the exterior lift frame 220, that is configured to temporarily secure to at least a portion of the combustor assembly 20 and that is connected to the base portion 222 of the exterior lift frame 220.

The interior combustor assembly engagement frame 240 can comprise a variety of configurations to facilitate temporary securement to combustor assemblies 20. For example, in some embodiments, the interior combustor assembly engagement frame 240 may comprise a clam shell configuration capable of transitioning between an open and a closed state to temporarily secure to the combustor assembly 20. More specifically, in such embodiments, the interior combustor assembly engagement frame 240 may comprise two or more portions that can at least partially pivot away from one another to rotate open or, alternatively, completely separate away from one another, to accept at least a portion of the combustor assembly 20. The interior combustor assembly engagement frame 240 may then close back together around the combustor assembly 20 to provide temporary securement of the combustor assembly 20.

In some embodiments, the interior combustor assembly engagement frame 240 may comprise a configuration similar to the exterior lift frame 220. For example, as illustrated in FIGS. 6 and 7, the interior combustor assembly engagement frame 240 may comprise a base portion 242 and an arm portion 244 wherein the arm portion 244 extends away from the base portion. The arm portion 244 may be utilized for temporary securement to the combustor assembly 125 while the base portion 242 may be utilized for connection of the interior combustor assembly engagement frame 240 to the exterior lift frame 220.

In these or other embodiments, the interior combustor assembly engagement frame 240 may be configured to temporarily secure to at least a portion of the combustor assembly 20 via one or more bolts. For example, the interior combustor assembly engagement frame 240 may comprise a plurality of holes that may be aligned with corresponding holes on the combustor assembly 20. Once aligned, bolts may be passed through both sets of corresponding holes to temporarily secure the combustor assembly 20 to the interior combustor assembly engagement frame 240.

Moreover, in some embodiments, the interior combustor assembly engagement frame 240 may be entirely disposed within the exterior lift frame 220. Specifically, the arm portion 224 of the exterior lift frame 220 may extend past the interior combustor assembly engagement frame 240. Such embodiments may ensure that the exterior lift frame 220 provides suitable clearance for the interior combustor assembly engagement frame 240 and a combustor assembly 20 temporarily secured thereto when the combustor assembly 20 is being installed or removed from a turbomachine 100.

While particular embodiments of the interior combustor assembly engagement frame 240 have been disclosed herein to illustrate possible temporary securement configurations between the interior combustor assembly engagement frame 240 and the combustor assembly 20, it should be appreciated that these are exemplary only and not intended to be limiting. Additional or alternative configurations may also be realized to facilitate the temporary securement of the combustor assembly 20 to the interior combustor assembly engagement frame 240 of the combustor assembly lift system 200.

The interior combustor assembly engagement frame 240 may be connected to the exterior lift frame 220 in a variety of configurations to facilitate the lifting and movement of a secured combustor assembly 20 such as for the removal or installation of said combustor assembly 20 with respect to a turbomachine 100. For example, a connection 230 between the interior combustor assembly engagement frame 240 and the exterior lift frame 220 may comprise a rotational connection wherein the interior combustor assembly engagement frame 240 can rotate relative to the exterior lift frame 220. The rotational connection may enable rotation about any axis or axes to help facilitate rotational orientation between the combustor assembly 20 and its respective slot in the turbomachine 100. The rotational connection can be facilitated through any suitable configuration such as, but not limited to, a ball joint (e.g., ball-and-socket) connection as illustrated in FIGS. 4-5. In other embodiments, the rotational connection may comprise a threaded connection, a bolt and washer connection, or any other suitable connection.

Figure 8:
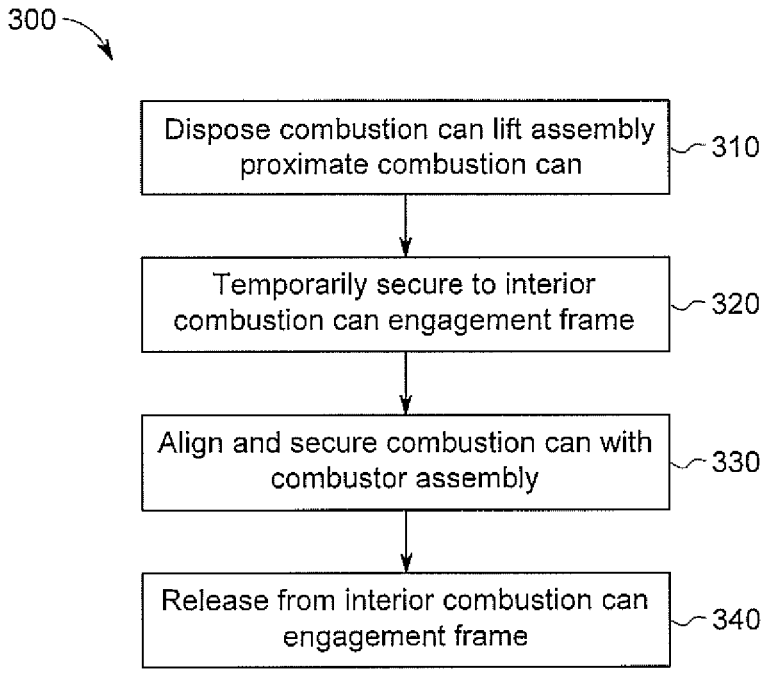
FIG. 8 illustrates a method for installing a combustor assembly according to one or more embodiments shown or described herein.

With additional reference to FIG. 8, a method 300 is illustrated for installing a combustor assembly 20 on a of a turbomachine 100. The method generally comprises disposing a combustor assembly lift system 200 proximate the combustor assembly 20 in step 310. As discussed above, the combustor assembly lift system 200 can comprise an exterior lift frame 220 comprising a base portion 222 and an arm portion 224, wherein the arm portion 224 extends away from a base portion 222 to form an interior 205, and an interior combustor assembly engagement frame 240 at least partially disposed in the interior 205 of the exterior lift frame 220 and configured to temporarily secure to at least a portion of a combustor assembly 20, wherein the interior combustor assembly engagement frame 240 is connected to the base portion 222 of the exterior lift frame 240.

In some embodiments, disposing the combustor assembly lift system 200 proximate the combustor assembly 20 in step 310 comprises disposing the combustor assembly lift system 200 in vertical alignment over the combustor assembly 20 while the combustor assembly 20 is disposed in a shipping container. Such embodiments can facilitate using a single combustor assembly lift system 200 for removal of the combustor assembly 20 from the shipping container, movement of the combustor assembly 20 to the turbomachine 100, and finally alignment and installation of the combustor assembly 20 with its respective slot on the turbomachine 100.

The method 300 may further comprise temporarily securing the interior combustor assembly engagement frame 240 to the combustor assembly 20 in step 320. As discussed herein, the interior combustor assembly engagement frame 240 may be temporarily secured to the combustor assembly 20 using a variety of configurations such as opening and closing a interior combustor assembly engagement frame 240 comprising a clamshell configuration, using one or more bolts, or using any other suitable securement system.

The method 300 may then comprise aligning and securing the combustor assembly 20 with the turbomachine 100 in step 320. Aligning the combustor assembly 20 may comprise moving the overall combustor assembly lift system 200 while the combustor assembly 20 is temporarily secured thereto by any suitable means. For example, in some embodiments one or more chains may be connected to one or more pick points on the exterior lift frame 220. In some particular embodiments, a first chain 270 may be connected to a base pick point 223 for lifting the combustor assembly 20 out of the shipping container in a vertical path. Subsequently, additional chains 270 may be connected to one or more side pick points 225 to help transfer the load and/or rotate the combustor assembly 20 towards a more horizontal orientation that better aligns with its corresponding slot in the turbomachine 100. Securing the combustor assembly 20 to the turbomachine 100 may also be achieved through any suitable technique as should be appreciated to those skilled in the arts. For example, the combustor assembly 20 may be secured via one or more bolts, clamps, or the like.

Finally, method 300 may comprise releasing the combustor assembly 20 from the interior combustor assembly engagement frame 240 in step 340. Releasing the combustor assembly 20 can comprise any suitable method based on the configuration of the interior combustor assembly engagement frame 240 (e.g., opening the interior combustor assembly engagement frame 240 or unbolting the interior combustor assembly engagement frame 240).

Figure 9:
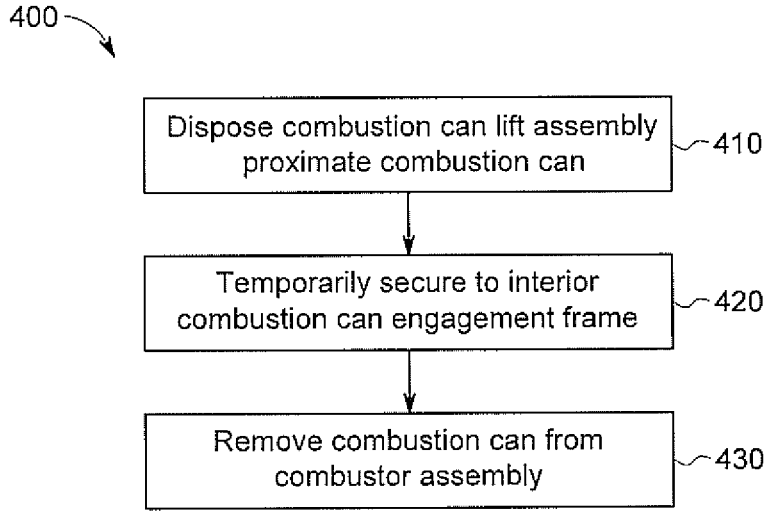
FIG. 9 illustrates a method for removing a combustor assembly according to one or more embodiments shown or described herein.

With additional reference to FIG. 9, a method 400 is illustrated for removing a combustor assembly 20 from a turbomachine 100. The method generally comprises disposing a combustor assembly lift system 200 proximate the combustor assembly 20 in step 410. As discussed above, the combustor assembly lift system 200 can comprise an exterior lift frame comprising a base portion 222 and an arm portion 224, wherein the arm portion 224 extends away from a base portion to form an interior 205, and an interior combustor assembly engagement frame 240 at least partially disposed in the interior 205 of the exterior lift frame 220 and configured to temporarily secure to at least a portion of a combustor assembly 20, wherein the interior combustor assembly engagement frame 240 is connected to the base portion 222 of the exterior lift frame 220.

The method 400 may further comprise temporarily securing the interior combustor assembly engagement frame 240 to the combustor assembly 20 in step 420. As discussed herein, the interior combustor assembly engagement frame 240 may be temporarily secured to the combustor assembly 20 using a variety of configurations such as opening and closing an interior combustor assembly engagement frame 240 comprising a clamshell configuration, using one or more bolts, or using any other suitable securement system.

Finally, the method 400 may further comprise releasing the combustor assembly 20 from the turbomachine 100 and moving the combustor assembly lift system 200 away from the turbomachine 100 via one or more connections to the exterior lift frame 220 in step 430. Releasing the combustor assembly 20 from the turbomachine 100 may be achieved through any suitable means based on the respective configuration of the combustor assembly 20 and the turbomachine 100. For example, in some embodiments, releasing the combustor assembly 20 may comprise removing one or more bolts connecting the combustor assembly 20 to the turbomachine 100. Moreover, moving the combustor assembly lift system 200 may be achieved through any suitable means such as one or more chains connected to one or more pick points on the exterior lift frame 220.

In some embodiments, method 400 may further comprise transitioning the combustor assembly lift system 200 to a substantially vertical orientation while the combustor assembly 20 is still temporarily secured to the interior combustor assembly engagement frame 240. Such embodiments may then further comprise lowering the combustor assembly 20 into a shipping container and releasing the combustor assembly 20 from the interior combustor assembly engagement frame 240. Similar to the installation method 300 discussed above, such removal methods 400 may facilitate the removal of the combustor assembly 20 from its slot in the turbomachine 100 along with its subsequent placement in a shipping container using a single combustor assembly lift system 200.

It should now be appreciated that combustor assembly lift systems as disclosed herein can be provided to help install, remove, or re-install combustor assemblies into combustor assemblies of turbomachines. Such combustor assembly lift systems can facilitate proper alignment specific to each combustor assembly while enabling a continuous installation and/or removal process via a single combustor assembly lift system. These combustor assembly lift systems and methods may thereby provide for simpler and faster overall installation and removal activities.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A combustor assembly lift system comprising:

an exterior lift frame comprising a base portion and an arm portion, wherein the arm portion extends away from the base portion to form an interior; and an interior combustor assembly engagement frame at least partially disposed in the interior of the exterior lift frame and configured to temporarily secure to at least a portion of a combustor assembly, the interior combustor assembly engagement frame is connected to the base portion of the exterior lift frame and wherein the arm portion comprises at least one side pick point on an axis extending through a center of gravity of the combustor lift assembly when the combustor lift assembly is secured to the combustor assembly thereby balancing loads of the combustor lift assembly and the combustor assembly relative to the axis and enabling selective vertical rotational alignment of the combustor assembly lift system, wherein a connection between the interior combustor assembly engagement frame and the exterior lift frame comprises a rotational connection wherein the interior combustor assembly engagement frame can rotate relative to the exterior lift frame.

2. The combustor assembly lift system of claim 1, wherein the connection between the interior combustor assembly engagement frame and the exterior lift frame comprises a ball joint connection.

3. The combustor assembly lift system of claim 1, wherein the base portion of the exterior lift frame comprises one or more base pick points.

4. The combustor assembly lift system of claim 1, wherein the arm portion of the exterior lift frame extends past the interior combustor assembly engagement frame.

5. The combustor assembly lift system of claim 1, wherein the interior combustor assembly engagement frame comprises a clam shell configuration configured to transition between an open state and a closed state to temporarily secure to the combustor assembly.

6. The combustor assembly lift system of claim 1, wherein the interior combustor assembly engagement frame is configured to temporarily secure to at least a portion of the combustor assembly via one or more bolts.

7. The combustor assembly lift system of claim 1, wherein the arm portion of the exterior lift frame comprises one or more alignment bolts configured to engage one or more holes on the turbomachine.

8. The combustor assembly lift system of claim 1, wherein a protective barrier extends at least partially around the arm portion of the exterior lift frame.

9. The combustor assembly lift system of claim 1, wherein the arm portion comprises a plurality of arms extending away from the base portion.

10. The combustor assembly lift system of claim 1, wherein the combustor assembly comprises a unibody combustor assembly comprising a combustion can and at least one of a flow sleeve or a combustion liner connected to the combustion can.

11. The combustor assembly lift system of claim 1, wherein the interior combustor assembly engagement frame comprises an interior base portion and an interior arm portion that extends away from the interior base portion.

12. The combustor assembly lift system of claim 11, wherein the interior base portion of the interior combustor assembly engagement frame is connected to the base portion of the exterior lift frame.

13. A method for installing a combustor assembly on a turbomachine, the method comprising:

disposing a combustor assembly lift system proximate the combustor assembly, the combustor assembly lift system comprising:

an exterior lift frame comprising a base portion and an arm portion, wherein the arm portion extends away from the base portion to form an interior, wherein the arm portion comprises at least one pick point that enables selective vertical rotational alignment of the combustor assembly lift system;

an interior combustor assembly engagement frame at least partially disposed in the interior of the exterior lift frame and configured to temporarily secure to at least a portion of a combustor assembly and wherein the at least one side pick point is on an axis extending through the center of gravity of the combustor lift assembly when the combustor lift assembly is secured to the combustor assembly thereby balancing loads of the combustor lift assembly and the combustor assembly relative to the axis;

wherein the interior combustor assembly engagement frame is connected to the base portion of the exterior lift frame, and wherein a connection between the interior combustor assembly engagement frame and the exterior lift frame comprises a rotational connection wherein the interior combustor assembly engagement frame can rotate relative to the exterior lift frame;

temporarily securing the interior combustor assembly engagement frame to the combustor assembly;

aligning and securing the combustor assembly with the turbomachine; and, releasing the combustor assembly from the interior combustor assembly engagement frame.

14. The method of claim 13, wherein disposing the combustor assembly lift system proximate the combustor assembly comprises disposing the combustor assembly lift system in vertical alignment over the combustor assembly while the combustor assembly is disposed in a shipping container.

15. A method for removing a combustor assembly from a turbomachine, the method comprising:

disposing a combustor assembly lift system proximate the combustor assembly, the combustor assembly lift system comprising:

an exterior lift frame comprising a base portion and an arm portion, wherein the arm portion extends away from the base portion to form an interior, wherein the arm portion comprises at least one side pick point;

an interior combustor assembly engagement frame at least partially disposed in the interior of the exterior lift frame and configured to temporarily secure to at least a portion of a combustor assembly wherein the at least one pick point is on an axis extending through the center of gravity of the exterior lift frame and the interior combustor assembly when the interior combustor assembly is secured to the combustor assembly, thereby balancing loads of the exterior lift frame, the interior combustor assembly engagement frame, and the combustor assembly relative to the axis and enabling selective vertical rotational alignment of the exterior lift frame, the interior combustor assembly engagement frame and the combustor assembly;

wherein the interior combustor assembly engagement frame is connected to the base portion of the exterior lift frame, and wherein a connection between the interior combustor assembly engagement frame and the exterior lift frame comprises a rotational connection wherein the interior combustor assembly engagement frame can rotate relative to the exterior lift frame;

temporarily securing the interior combustor assembly engagement frame to the combustor assembly;

releasing the combustor assembly from the turbomachine and moving the combustor assembly lift system away from the turbomachine via one or more connections to the exterior lift frame.

16. The method of claim 15, further comprising transitioning the combustor assembly lift system to a substantially vertical orientation while the combustor assembly is still temporarily secured to the interior combustor assembly engagement frame.

17. The method of claim 16, further comprising lowering the combustor assembly into a shipping container and releasing the combustor assembly from the interior combustor assembly engagement frame.

* * * * *